US011540052B1

(12) United States Patent
Peterson et al.

(10) Patent No.: US 11,540,052 B1
(45) Date of Patent: Dec. 27, 2022

(54) AUDIO COMPONENT ADJUSTMENT BASED ON LOCATION

(71) Applicant: Lenovo (United states) Inc., Morrisville, NC (US)

(72) Inventors: Nathan Peterson, Oxford, NC (US); Gary D. Cudak, Wake Forest, NC (US); John M. Petersen, Wake Forest, NC (US)

(73) Assignee: Lenovo (United States) Inc., Morrisville, NC (US)

( * ) Notice: Subject to any disclaimer, the term of this patent is extended or adjusted under 35 U.S.C. 154(b) by 0 days.

(21) Appl. No.: 17/522,466

(22) Filed: Nov. 9, 2021

(51) Int. Cl.
*H04R 3/12* (2006.01)
*G10L 25/51* (2013.01)

(52) U.S. Cl.
CPC ..... *H04R 3/12* (2013.01); *G10L 25/51* (2013.01); *H04R 2430/01* (2013.01)

(58) Field of Classification Search
None
See application file for complete search history.

(56) References Cited

U.S. PATENT DOCUMENTS 7,746,964 B2 * 6/2010 Nakano ..... H04S 7/00 375/345
9,380,386 B2 * 6/2016 Fujita ..... H04R 3/04
9,538,288 B2 * 1/2017 Tawada ..... H04R 5/04
9,659,571 B2 * 5/2017 Van Der Schaar ..... G10L 21/02
9,859,858 B2 * 1/2018 Porter ..... H03G 7/002
10,026,416 B2 * 7/2018 Takasu ..... H03G 3/002
10,231,072 B2 * 3/2019 Takahashi ..... H04S 7/303
10,333,482 B1 * 6/2019 Shi ..... H04R 3/04
2008/0037805 A1 * 2/2008 Kino ..... H04S 7/301 381/101
2008/0240461 A1 10/2008 Nakamura et al.
2009/0016540 A1 * 1/2009 Heningsen Nielsen . H03G 1/02 381/56
2009/0304205 A1 12/2009 Hardacker et al.
2011/0091055 A1 4/2011 LeBlanc
2013/0024018 A1 1/2013 Chang et al.
2013/0066453 A1 * 3/2013 Seefeldt ..... H04S 7/301 700/94

(Continued)

OTHER PUBLICATIONS

Peterson et al., "Systems and Methods to Increase Volume of Audio Output by a Device", file history of related U.S. Appl. No. 15/648,781, filed Jul. 13, 2017.

(Continued)

*Primary Examiner* — Paul W Huber
(74) *Attorney, Agent, or Firm* — John M. Rogitz; John L. Rogitz

(57) ABSTRACT

In one aspect, a device may include at least one processor and storage accessible to the at least one processor. The storage may include instructions executable by the at least one processor to identify at least one characteristic associated with audio as sensed at a first location, with the audio being produced at a second location that is different from the first location. The instructions may also be executable to, based on the at least one identified characteristic, adjust a first volume level of a first component of the audio in a first frequency and/or first frequency band but not a second volume level of a second component of the audio in a second frequency and/or second frequency band of the audio.

20 Claims, 4 Drawing Sheets

(56) References Cited

U.S. PATENT DOCUMENTS

| | | | | |
|---|---|---|---|---|
| 2013/0289983 | A1 | 10/2013 | Park et al. | |
| 2015/0222977 | A1 | 8/2015 | Angel, Jr. | |
| 2015/0334079 | A1 | 11/2015 | Laidlaw et al. | |
| 2016/0286313 | A1 | 9/2016 | Kofman et al. | |
| 2017/0287321 | A1 | 10/2017 | Ann et al. | |
| 2021/0194447 | A1* | 6/2021 | Shaya | H04S 7/305 |
| 2022/0199066 | A1* | 6/2022 | Trivedi | H03G 3/32 |

OTHER PUBLICATIONS

"Bass (sound)", Wikipedia, retrieved on Sep. 10, 2021 from https://en.wikipedia.org/wiki/Bass_(sound).
"Treble (sound)". Wikipedia, retrieved on Sep. 10, 2021 from https://en.wikipedia.org/wiki/Treble_(sound).
"Wavelet transform", Wikipedia, retrieved on Sep. 10, 2021 from https://en.wikipedia.org/wiki/Wavelet_transform.

* cited by examiner

AUDIO COMPONENT ADJUSTMENT BASED ON LOCATION

FIELD

The disclosure below relates to technically inventive, non-routine solutions that are necessarily rooted in computer technology and that produce concrete technical improvements. In particular, the disclosure below relates to techniques for audio component adjustment based on location.

BACKGROUND

As recognized herein, various frequencies of audio produced through one or more speakers may travel farther than other frequencies, and also various frequencies can be affected differently by objects that the audio might pass through or around. As a consequence, and as also recognized herein, this can lead to poor experiences such as being able to hear some but not all of the audio itself depending on the distance of the listener to the source. There are currently no adequate solutions to the foregoing computer-related, technological problem.

SUMMARY

Accordingly, in one aspect a first device includes at least one processor and storage accessible to the at least one processor. The storage includes instructions executable by the at least one processor to identify at least one characteristic of audio as sensed at a first location, where the audio is produced at a second location that is different from the first location. The instructions are also executable to, based on the at least one identified characteristic, adjust output of a first audio component in a first frequency and/or first frequency band of the audio but not a second audio component in a second frequency and/or second frequency band of the audio.

Thus, in some examples the identification may be performed based on input from at least one microphone disposed at the first location. If desired, the first device may include the at least one microphone and the identification may be performed while the first device is at the first location. So, for example, adjusting the output of the first audio component but not the second audio component may include transmitting an indication to a second device that controls one or more speakers to produce the audio, where the indication may indicate that the second device is to adjust the output of the first audio component. The second device may be different from the first device.

Also in some examples, the instructions may be executable to control one or more speakers in communication with the first device to adjust the output of the first audio component. Thus, if desired the instructions may be executable to receive microphone input from a second device different from the first device, where the second device may be disposed at the first location. The instructions may then be executable to identify the at least one characteristic based on the microphone input and control the one or more speakers based on the identified characteristic to adjust the output of the first audio component.

Still further, in some example implementations the instructions may be executable to, based on the at least one identified characteristic, adjust output of the first audio component so that a first volume level of the first audio component, at the first location, is proportional to within a threshold volume level to other volume levels of other audio components in other frequencies and/or frequency bands at the first location according to respective volume levels for the respective audio components as produced at the second location. Thus, if desired the instructions may be executable to progressively raise output of the first audio component in the first frequency and/or first frequency band to reach the first volume level at the first location.

In various examples, the first frequency and/or first frequency band may fall within a treble frequency band and the second frequency and/or second frequency band may fall within a bass frequency band. The treble frequency band may include frequencies in the band of 4,000 Hz and 20,000 Hz, and the bass frequency band may include frequencies in the band of 16 Hz to 250 Hz.

Additionally, in some example implementations the instructions may be executable to adjust the output of the first audio component using a digital equalizer and/or a waveform transformation.

In another aspect, a method includes identifying a first volume level of a first audio component in a first frequency and/or first frequency range as sensed at a first location. The first audio component forms part of audio produced at a second location that is different from the first location. The method also includes, based on the first volume level, adjusting volume levels of one or more audio components of the audio but not other volume levels of other audio components of the audio.

Thus, in some examples the method may include, based on the first volume level, adjusting volume of the first audio component.

Also in some examples, the method may include, based on the first volume level, raising volume of a second audio component different from the first audio component. Thus, if desired the method may include, based on the first volume level, raising volume of the second audio component so that volume of the second audio component, at the first location, is proportional to within a threshold volume to volume levels of other audio components in other frequencies and/or frequency ranges at the first location according to respective volume levels for the respective audio components as produced at the second location.

The first frequency and/or first frequency range may fall within a bass frequency range, where the bass frequency range may include frequencies in the range of 16 Hz to 250 Hz. Additionally, the second frequency and/or second frequency range may fall within a treble frequency range, where the treble frequency range may include frequencies in the range of 4,000 Hz and 20,000 Hz.

Additionally, in some examples the method may include, based on the first volume level, adjusting volume levels of the one or more audio components using a digital equalizer and/or a waveform transformation.

In still another aspect, at least one computer readable storage medium (CRSM) that is not a transitory signal includes instructions executable by at least one processor to identify at least one characteristic associated with audio as sensed at a first location. The audio is produced at a second location that is different from the first location. The instructions are also executable to, based on the at least one identified characteristic, adjust a first volume level of a first component of the audio in a first frequency and/or first frequency range but not a second volume level of a second component of the audio in a second frequency and/or second frequency range of the audio.

So, for example, the instructions may be executable to raise the first volume level of the first component but not the second volume level of the second component of the audio.

The first component may fall within a bass frequency range including frequencies in the range of 16 Hz to 250 Hz, while the second component may fall within a treble frequency range including frequencies in the range of 4,000 Hz and 20,000 Hz.

Additionally, in some example implementations the at least one characteristic associated with the audio may include additional sound produced by an object based on the production of the audio. The object may be different from one or more speakers producing the audio. In these implementations, the instructions may be executable to lower the first volume level of the first audio component based on the at least one identified characteristic, where the first audio component may fall within a bass frequency range including frequencies in the range of 16 Hz to 250 Hz.

The details of present principles, both as to their structure and operation, can best be understood in reference to the accompanying drawings, in which like reference numerals refer to like parts, and in which:

DETAILED DESCRIPTION

Figure 1:
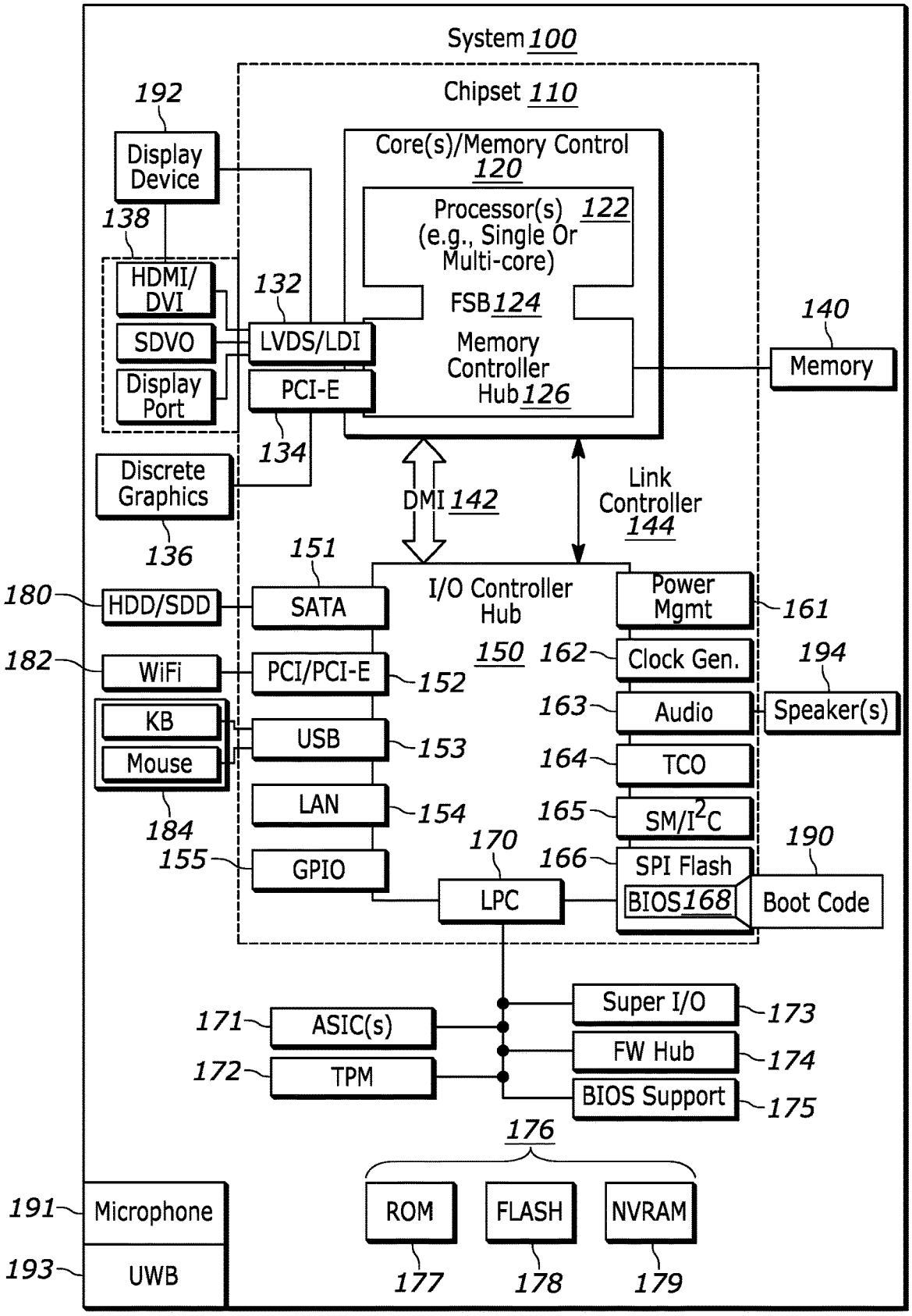
FIG. 1 is a block diagram of an example system consistent with present principles.

Among other things, the detailed description below relates to using devices such as Internet of things (IoT) and wearable devices that users have to determine where a user is located (e.g., via Bluetooth, ultra-wideband, GPS, etc.) and, based on user location and determined audio quality in a specific area of the house, building, or other area (e.g., room), determine audio quality characteristics for each room or other area. For example, low frequencies from songs being played in another part of the building might be heard by the device's microphone but not higher frequencies. Based on the determination of the frequency quality, each frequency of the audio itself may be tuned specific to each room in which that the user might be located.

Additionally, the devices may sample the received audio in a location where the user is located and determine if any additional ambient conditions might affect the sound quality. For example, a user might be in a room with a bunch of pint or shot glasses on a shelf and the bass of the audio might cause two or more glasses to strike each other and create an undesirable noise that detracts from the song being played. Thus, if the user is in that room, the low frequency/frequencies may be reduced because of the negative sound impacts of the ambient condition(s).

Furthermore, in some examples the sound characteristics could be learned per location within a building, and thus received audio sampling may be reduced over time and the audio adjustments may be made simply based on location determinations once a sufficient level of confidence has been reached in the sound characteristics of the location itself.

Prior to delving further into the details of the instant techniques, note with respect to any computer systems discussed herein that a system may include server and client components, connected over a network such that data may be exchanged between the client and server components. The client components may include one or more computing devices including televisions (e.g., smart TVs, Internet-enabled TVs), computers such as desktops, laptops and tablet computers, so-called convertible devices (e.g., having a tablet configuration and laptop configuration), and other mobile devices including smart phones. These client devices may employ, as non-limiting examples, operating systems from Apple Inc. of Cupertino Calif., Google Inc. of Mountain View, Calif., or Microsoft Corp. of Redmond, Wash. A Unix® or similar such as Linux® operating system may be used. These operating systems can execute one or more browsers such as a browser made by Microsoft or Google or Mozilla or another browser program that can access web pages and applications hosted by Internet servers over a network such as the Internet, a local intranet, or a virtual private network.

As used herein, instructions refer to computer-implemented steps for processing information in the system. Instructions can be implemented in software, firmware or hardware, or combinations thereof and include any type of programmed step undertaken by components of the system; hence, illustrative components, blocks, modules, circuits, and steps are sometimes set forth in terms of their functionality.

A processor may be any single- or multi-chip processor that can execute logic by means of various lines such as address lines, data lines, and control lines and registers and shift registers. Moreover, any logical blocks, modules, and circuits described herein can be implemented or performed with a system processor, a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can also be implemented by a controller or state machine or a combination of computing devices. Thus, the methods herein may be implemented as software instructions executed by a processor, suitably configured application specific integrated circuits (ASIC) or field programmable gate array (FPGA) modules, or any other convenient manner as would be appreciated by those skilled in those art. Where employed, the software instructions may also be embodied in a non-transitory device that is being vended and/or provided that is not a transitory, propagating signal and/or a signal per se (such as a hard disk drive, CD ROM, or Flash drive). The software code instructions may also be downloaded over the Internet. Accordingly, it is to be understood that although a software application for undertaking present principles may be vended with a device such as the system 100 described below, such an application may also be downloaded from a server to a device over a network such as the Internet.

Software modules and/or applications described by way of flow charts and/or user interfaces herein can include various sub-routines, procedures, etc. Without limiting the disclosure, logic stated to be executed by a particular module can be redistributed to other software modules and/or combined together in a single module and/or made available in a shareable library. Also, the user interfaces (UI)/graphical UIs described herein may be consolidated and/or expanded, and UI elements may be mixed and matched between UIs.

Logic when implemented in software, can be written in an appropriate language such as but not limited to hypertext markup language (HTML)-5, Java/JavaScript, C# or C++, and can be stored on or transmitted from a computer-readable storage medium such as a random access memory (RAM), read-only memory (ROM), electrically erasable programmable read-only memory (EEPROM), a hard disk drive or solid state drive, compact disk read-only memory (CD-ROM) or other optical disk storage such as digital versatile disc (DVD), magnetic disk storage or other magnetic storage devices including removable thumb drives, etc.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can be used in other embodiments in any appropriate combination. For example, any of the various components described herein and/or depicted in the Figures may be combined, interchanged, or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

The term "circuit" or "circuitry" may be used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

Now specifically in reference to FIG. 1, an example block diagram of an information handling system and/or computer system 100 is shown that is understood to have a housing for the components described below. Note that in some embodiments the system 100 may be a desktop computer system, such as one of the ThinkCentre® or ThinkPad® series of personal computers sold by Lenovo (US) Inc. of Morrisville, N.C., or a workstation computer, such as the ThinkStation®, which are sold by Lenovo (US) Inc. of Morrisville, N.C.; however, as apparent from the description herein, a client device, a server or other machine in accordance with present principles may include other features or only some of the features of the system 100. Also, the system 100 may be, e.g., a game console such as XBOX®, and/or the system 100 may include a mobile communication device such as a mobile telephone, notebook computer, and/or other portable computerized device.

As shown in FIG. 1, the system 100 may include a so-called chipset 110. A chipset refers to a group of integrated circuits, or chips, that are designed to work together. Chipsets are usually marketed as a single product (e.g., consider chipsets marketed under the brands INTEL®, AMD®, etc.).

In the example of FIG. 1, the chipset 110 has a particular architecture, which may vary to some extent depending on brand or manufacturer. The architecture of the chipset 110 includes a core and memory control group 120 and an I/O controller hub 150 that exchange information (e.g., data, signals, commands, etc.) via, for example, a direct management interface or direct media interface (DMI) 142 or a link controller 144. In the example of FIG. 1, the DMI 142 is a chip-to-chip interface (sometimes referred to as being a link between a "northbridge" and a "southbridge").

The core and memory control group 120 include one or more processors 122 (e.g., single core or multi-core, etc.) and a memory controller hub 126 that exchange information via a front side bus (FSB) 124. As described herein, various components of the core and memory control group 120 may be integrated onto a single processor die, for example, to make a chip that supplants the "northbridge" style architecture.

The memory controller hub 126 interfaces with memory 140. For example, the memory controller hub 126 may provide support for DDR SDRAM memory (e.g., DDR, DDR2, DDR3, etc.). In general, the memory 140 is a type of random-access memory (RAM). It is often referred to as "system memory."

The memory controller hub 126 can further include a low-voltage differential signaling interface (LVDS) 132. The LVDS 132 may be a so-called LVDS Display Interface (LDI) for support of a display device 192 (e.g., a CRT, a flat panel, a projector, a touch-enabled light emitting diode (LED) display or other video display, etc.). A block 138 includes some examples of technologies that may be supported via the LVDS interface 132 (e.g., serial digital video, HDMI/DVI, display port). The memory controller hub 126 also includes one or more PCI-express interfaces (PCI-E) 134, for example, for support of discrete graphics 136. Discrete graphics using a PCI-E interface has become an alternative approach to an accelerated graphics port (AGP). For example, the memory controller hub 126 may include a 16-lane (x16) PCI-E port for an external PCI-E-based graphics card (including, e.g., one of more GPUs). An example system may include AGP or PCI-E for support of graphics.

In examples in which it is used, the I/O hub controller 150 can include a variety of interfaces. The example of FIG. 1 includes a SATA interface 151, one or more PCI-E interfaces 152 (optionally one or more legacy PCI interfaces), one or more universal serial bus (USB) interfaces 153, a local area network (LAN) interface 154 (more generally a network interface for communication over at least one network such as the Internet, a WAN, a LAN, a Bluetooth network using Bluetooth 5.0 communication, etc. under direction of the processor(s) 122), a general purpose I/O interface (GPIO) 155, a low-pin count (LPC) interface 170, a power management interface 161, a clock generator interface 162, an audio interface 163 (e.g., for speakers 194 to output audio), a total cost of operation (TCO) interface 164, a system management bus interface (e.g., a multi-master serial computer bus interface) 165, and a serial peripheral flash memory/controller interface (SPI Flash) 166, which, in the example of FIG. 1, includes basic input/output system (BIOS) 168 and boot code 190. With respect to network connections, the I/O hub controller 150 may include integrated gigabit Ethernet controller lines multiplexed with a PCI-E interface port. Other network features may operate independent of a PCI-E interface.

The interfaces of the I/O hub controller 150 may provide for communication with various devices, networks, etc. For example, where used, the SATA interface 151 provides for reading, writing, or reading and writing information on one or more drives 180 such as HDDs, SDDs or a combination thereof, but in any case, the drives 180 are understood to be, e.g., tangible computer readable storage mediums that are not transitory, propagating signals. The I/O hub controller 150 may also include an advanced host controller interface (AHCI) to support one or more drives 180. The PCI-E interface 152 allows for wireless connections 182 to devices, networks, etc. The USB interface 153 provides for input devices 184 such as keyboards (KB), mice and various other devices (e.g., cameras, phones, storage, media players, etc.).

In the example of FIG. 1, the LPC interface 170 provides for use of one or more ASICs 171, a trusted platform module (TPM) 172, a super I/O 173, a firmware hub 174, BIOS support 175 as well as various types of memory 176 such as ROM 177, Flash 178, and non-volatile RAM (NVRAIVI) 179. With respect to the TPM 172, this module may be in the form of a chip that can be used to authenticate software and hardware devices. For example, a TPM may be capable of performing platform authentication and may be used to verify that a system seeking access is the expected system.

The system 100, upon power on, may be configured to execute boot code 190 for the BIOS 168, as stored within the SPI Flash 166, and thereafter processes data under the control of one or more operating systems and application software (e.g., stored in system memory 140). An operating system may be stored in any of a variety of locations and accessed, for example, according to instructions of the BIOS 168.

Additionally, the system 100 may include an audio receiver/microphone 191 that provides input from the microphone 191 to the processor 122 based on audio that is detected, such music or other audio detected by the microphone 191 consistent with present principles.

As also shown in FIG. 1, the system 100 may include an ultra-wideband (UWB) transceiver 193 (and/or other wireless transceiver such as a Bluetooth transceiver) for location tracking consistent with present principles. The UWB transceiver 193 may be configured to transmit and receive data using UWB signals and UWB communication protocol(s), such as protocols set forth by the FiRa Consortium. As understood herein, UWB may use low energy, short-range, high-bandwidth pulse communication over a relatively large portion of the radio spectrum. Thus, for example, an ultra-wideband signal/pulse may be established by a radio signal with fractional bandwidth greater than 20% and/or a bandwidth greater than 500 MHz. UWB communication may occur by using multiple frequencies (e.g., concurrently) in the frequency range from 3.1 to 10.6 GHz in certain examples.

To transmit UWB signals consistent with present principles, the transceiver 193 itself may include one or more Vivaldi antennas and/or a MIMO (multiple-input and multiple-output) distributed antenna system, for example. It is to be further understood that various UWB algorithms, time difference of arrival (TDoA) algorithms, and/or angle of arrival (AoA) algorithms may be used for system 100 to determine the distance to and location of another UWB transceiver on another device that is in communication with the UWB transceiver 193 on the system 100 to thus track the real-time location of the other device in relatively precise fashion consistent with present principles. The orientation of the other device may even be tracked via the UWB signals.

Additionally, though not shown for simplicity, in some embodiments the system 100 may include a gyroscope that senses and/or measures the orientation of the system 100 and provides related input to the processor 122, as well as an accelerometer that senses acceleration and/or movement of the system 100 and provides related input to the processor 122. The system 100 may also include a camera that gathers one or more images and provides the images and related input to the processor 122. The camera may be a thermal imaging camera, an infrared (IR) camera, a digital camera such as a webcam, a three-dimensional (3D) camera, and/or a camera otherwise integrated into the system 100 and controllable by the processor 122 to gather still images and/or video.

Still further, the system 100 may include a global positioning system (GPS) transceiver that is configured to communicate with at least one satellite to receive/identify geographic position information and provide the geographic position information to the processor 122. However, it is to be understood that another suitable position receiver other than a GPS receiver or UWB transceiver may be used in accordance with present principles to determine the location of a device such as the system 100.

It is to be understood that an example client device or other machine/computer may include fewer or more features than shown on the system 100 of FIG. 1. In any case, it is to be understood at least based on the foregoing that the system 100 is configured to undertake present principles.

Figure 2:
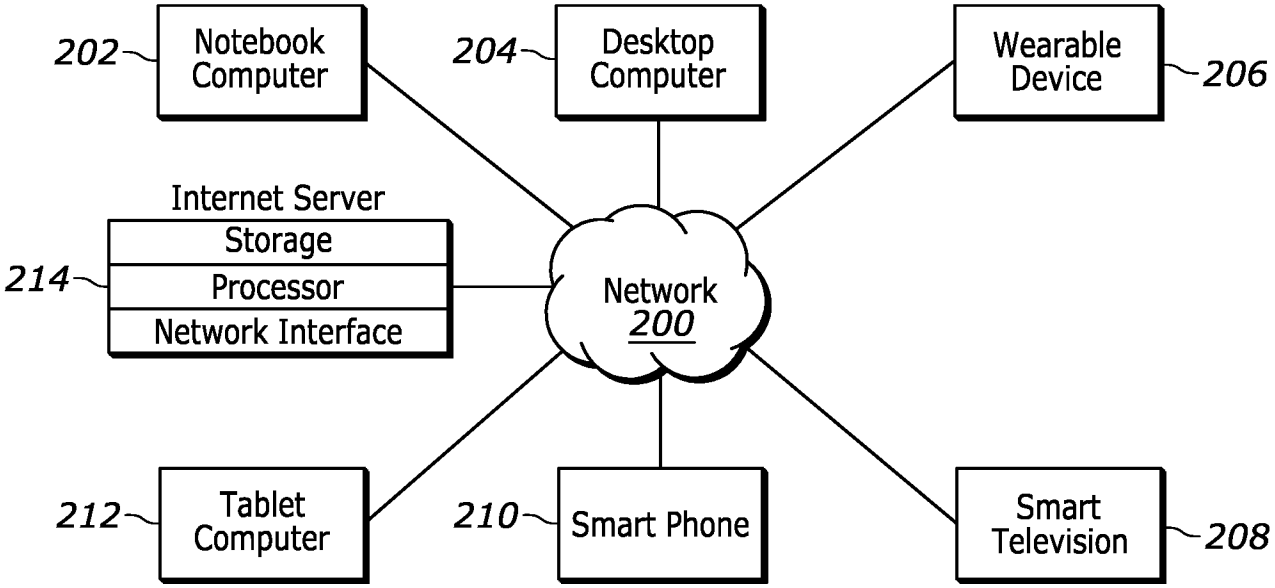
FIG. 2 is a block diagram of an example network of devices consistent with present principles.

Turning now to FIG. 2, example devices are shown communicating over a network 200 such as the Internet, a UWB network, a Bluetooth network, etc. in accordance with present principles. It is to be understood that each of the devices described in reference to FIG. 2 may include at least some of the features, components, and/or elements of the system 100 described above. Indeed, any of the devices disclosed herein may include at least some of the features, components, and/or elements of the system 100 described above.

FIG. 2 shows a notebook computer and/or convertible computer 202, a desktop computer 204, a wearable device 206 such as a smart watch, a smart television (TV) 208, a smart phone 210, a tablet computer 212, and a server 214 such as an Internet server that may provide cloud storage accessible to the devices 202-212. It is to be understood that the devices 202-214 may be configured to communicate with each other over the network 200 to undertake present principles (e.g., to control speakers, transmit microphone input from one device to another, etc.).

Figure 3:
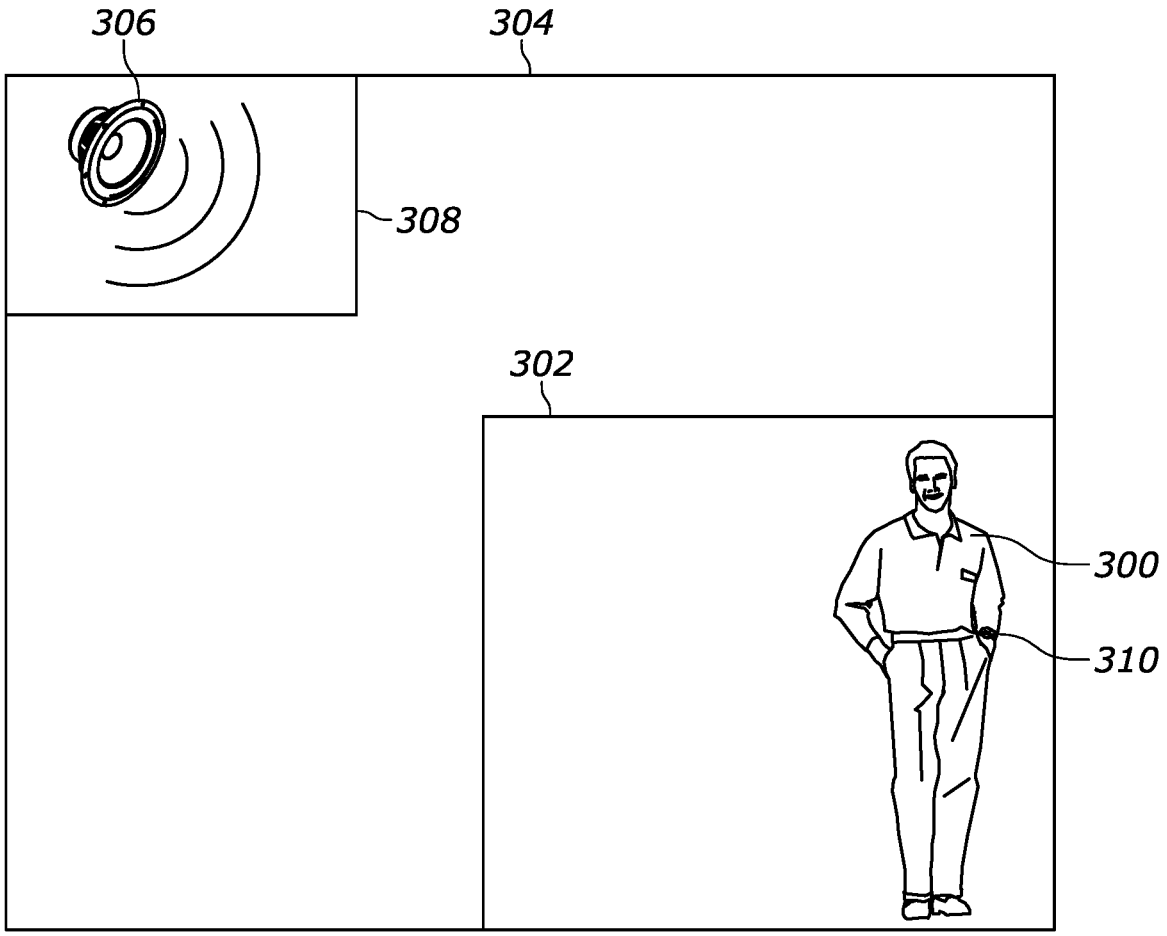
FIG. 3 is a diagram of an example residential floor layout with a speaker producing audio in one room and a user listening from another room consistent with present principles.

Now in reference to FIG. 3, suppose an end-user 300 is located within a first room 302 of a personal residence 304 while music, other audio such as a podcast or other voice recording, or even audio-visual content such as a television program or motion picture is being presented via a device having one or more speakers 306 that is located within a second room 308. Here assume that owing to the user's distance to the speakers 306 and/or owing to the walls in between as illustrated in the floorplan of FIG. 3, the user 300 may not be able to hear all frequencies of the audio proportional to their actual volume levels as produced via the speakers 306. For example, the user might be able to hear the bass component without hearing the treble component of the audio at all, or vice versa.

Consistent with present principles, a wearable device such as a smartwatch 310 or other device within the room 302 (e.g., worn by the user) may track the user's location to identify the user as being within the room 302 for purposes to be described further below. Additionally, or alternatively, a microphone disposed on the smartwatch 310 or other device may detect the audio at/proximate to the user's current location within the room 302 and determine which components of the audio in which frequencies can be detected via the microphone (and at which relative or absolute volume levels), and also which components of the audio in other frequencies cannot be detected at all. The watch 310 may do so without knowing the specific audio that is being produced simply by identifying audio production as opposed to a person speaking for example or may communicate with the other device controlling the speakers 306 in order to identify the particular audio being produced to then match one or more frequencies of the audio to the frequencies detected at the microphone itself. The other device may also communicate to the watch 310 the particular volume levels of the various audio components themselves as produced by the speakers 306.

Based on the foregoing, the watch 310 may then transmit an indication to the other device that indicates that certain components of the audio in certain frequencies cannot be heard at the microphone, or that the volume levels of certain components at the microphone's location are not proportional to the respective volume levels of other respective components at the microphone's location relative to the respective volume levels of each respective component as produced by the speakers 306 themselves (e.g., since some frequencies might travel further to the room 302 and thus be more audible than others in the room 302). The other device may then raise or lower the volume levels of various components of the audio in various frequencies (as produced by the speakers 306 themselves) so that all volume levels of all components of the audio as detected by the microphone of the watch 310 within the room 302 proportionally match the volume levels of those respective components relative to each other as produced at the speaker 306 itself. Thus, the overall volume level of the audio might still be less in the room 302 than if the user were in the room 308, but the volume levels of each respective component in different frequencies/ranges as heard within the room 302 may still be hearable within the room 302 in their same respective proportions relative to each other according to the audio output itself.

However, further note that in various other examples the watch 310 may itself command or otherwise control the other device to make these adjustments to audio output at the speakers 306, rather than simply transmitting an indication (e.g., command or request) to the other device for the other device to do so itself. Or in other examples, the watch 310 may simply stream or otherwise transmit its microphone input to the other device for the other device to take the rest of the actions described above to adjust the volume levels of certain audio components in certain frequencies but not the volume level of all of the audio components being produced. Or as another example, a remotely-located server or in-home IoT hub device may route communications between the two devices and itself take one or more of the actions described above as appropriate, depending on implementation. Or as but one more example, if the speaker(s) 306 are established by one or more stand-alone wireless speakers (e.g., Bluetooth speakers) and the audio itself is being streamed from the watch 310 to the speakers 306, the watch 310 as paired with the speakers 306 may communicate wirelessly with the speakers 306 to control the speakers 306 as described above.

Figure 4:
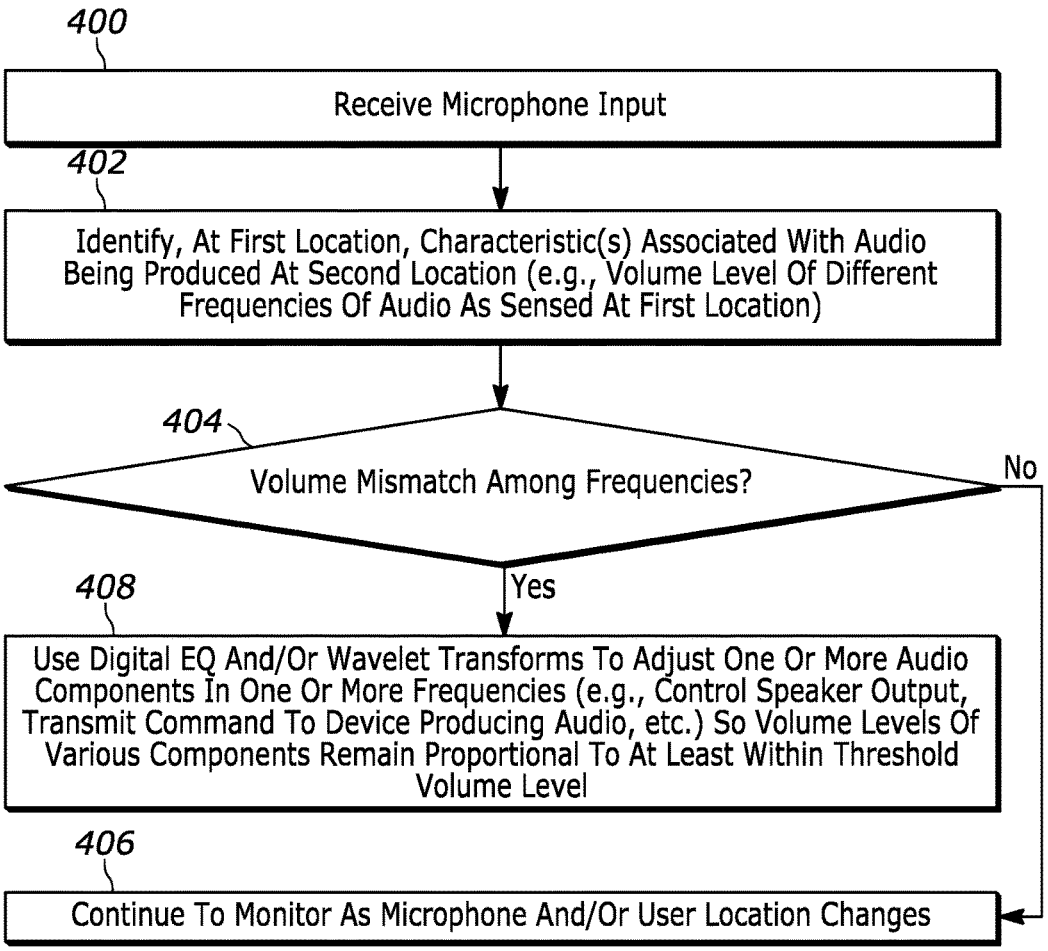
FIG. 4 illustrates example logic in example flow chart format that may be executed by a device consistent with present principles.

Continuing the detailed description in reference to FIG. 4, it shows example logic that may be executed by a device such as the system 100, watch 310, other device controlling the speakers 306, etc. alone or in any appropriate combination consistent with present principles. Note that while the logic of FIG. 4 is shown in flow chart format, other suitable logic may also be used.

Beginning at block 400, the device may receive microphone input from a microphone at a first location and then move to block 402. At block 402 the device may identify one or more characteristics associated with audio as sensed at a first location but produced at a second location that is different from the first location. For example, the characteristics may include the volume levels of various components of the audio in various frequencies as detected at the microphone itself, as well as other ambient sound conditions that might be detected and relate to the audio (e.g., glasses on a shelf clinking together in rhythm with a bass audio component of the audio as a result of the bass audio component traveling to the first location, a vibration of one part of another object relative to another part of the object that otherwise matches the rhythm of the bass audio component, etc.). From block 402 the logic may then proceed to decision diamond 404.

At diamond 404 the device may determine whether each audio component (e.g., in different frequencies or frequency bands/ranges) as sensed by the microphone at the first location has a volume level that is proportional to the volume levels of other audio components in other frequencies or frequency bands/ranges as also sensed by the microphone at the first location according to the audio file itself and/or the respective components of the audio as produced by the speakers themselves at the second location. A determination at diamond 404 of no frequency-based volume mismatches for the various audio components may cause the logic to proceed to block 406 where the device may continue to monitor the volume levels of the components in their different respective frequencies/bands at the microphone according to the description above to make changes at a later time depending on changes in the audio, changes to the location of the user, and/or changes to the location of the microphone so that no matter where the user might be located relative to the speakers, the volume levels of audio components in different frequencies or frequency bands remain proportional at the user's location as produced by the speakers themselves. For example, at block 406 the logic may revert back to block 400 and continue repeating until an affirmative determination is made at diamond 404.

Then once an affirmative determination of a volume mismatch is made at diamond 404, and/or based on another determination at diamond 404 such as the detection of other sounds produced by other objects based on the production of the audio itself, the logic may proceed to block 408. At block 408 the device may use an equalizer (such as a digital equalizer) and/or wavelet/waveform transformations as executed via audio processing software to adjust the volume level of components of the audio in one or more frequencies as output by the speakers themselves. In one embodiment, waveform transformations may thus be used to alter the overall waveform of the audio/audio stream based on the impact of the distance and/or material that otherwise alter the waveform (e.g., high/mid/low frequency) in a negative manner to adjust for that.

In any case, as an example, at block 408 the volume level of one or more components in a certain frequency/range may be progressively adjusted up or down over time until the volume level(s) of each component as sensed at the first location (the user's location) are proportional to each other at the first location as also produced by the speakers themselves at the second location per the description above (e.g., proportional at the first location at least to within a threshold volume level such as within twenty decibels as a computationally-acceptable margin of error).

Or as another example, if a certain bass frequency component (or even treble component) is determined to cause other undesirable noise such as glasses clinking per the description above and thus result in an affirmative determination at diamond 404, the audio component(s) in the bass frequency/range may be progressively reduced over time at block 408 until the microphone no longer detects the clinking of the other objects. The device may do so even if this results in the bass frequency component no longer being proportional per the above.

Figure 5:
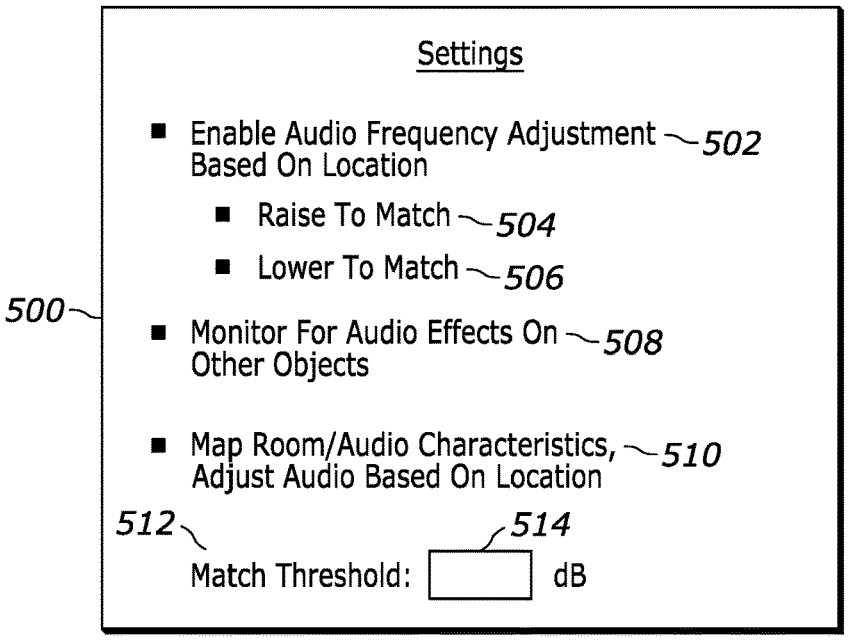
FIG. 5 shows an example graphical user interface (GUI) that may be presented on an electronic display to configure one or more settings of a device to operate consistent with present principles.

Now in reference to FIG. 5, an example graphical user interface (GUI) 500 is shown as may be presented on the display of one or more of the devices described above. For example, the GUI 500 may be presented on the display of the smartwatch 310 or the display of the other device controlling the speakers 306 themselves. The GUI 500 may be used for configuring one or more settings of a device or software application ("app") executing to undertake the actions described above. In the example shown, each option or sub-option of FIG. 5 may be selected by directing touch or cursor input to the respective checkbox adjacent to the respective option.

As shown in FIG. 5, the GUI 500 may include a first option 502 that may be selectable to set or configure the device or app to undertake the actions set forth above (e.g., for multiple future instances of audio production consistent with present principles). For example, the option may be selected to set or enable the device or app to undertake the actions described above in reference to FIG. 3 and/or execute the logic of FIG. 4.

FIG. 5 also shows that the first option 502 may be accompanied by sub-options 504, 506. The sub-option 504 may be selectable to specifically set or configure the device or app to raise the volume levels of audio components in certain frequencies or frequency bands when they are proportionally lower than they should be (as detected by a microphone at a location distanced from the sound source itself as described above). Alternatively, the sub-option 506 may be selected to set or configure the device or app to lower the volume levels of certain audio components in certain frequencies or frequency bands when they are proportionally higher than they should be rather than raising the volume levels of audio components that are too soft so that the audio does not cause noise pollution for others that might be closer to the speakers producing the audio than the microphone and hence user himself or herself.

The GUI 500 may also include an option 508 that may be selectable to set or enable the device or app to specifically monitor for the effects of the audio on other objects in the area of the microphone, such as glasses clinking or other things vibrating based on the audio's bass component(s) in order to adjust one or more frequencies of the audio based on that as also discussed above.

Still further, if desired the GUI 500 may include an option 510. The option 510 may be selected to set or configure the device to use UWB, other wireless technology, and/or other spatial mapping technology such as simultaneous localization and mapping (SLAM) or image registration to determine where a user is located (e.g., within a building) and then, based on user location and determined audio quality in a specific area in which the user is located, determine and store data related to audio quality characteristics of the defined area. Thus, based on the determination of the frequency quality of various frequencies for the area based on the area's relative distance to the audio source itself (e.g., in another room), each frequency of the audio itself may be tuned specific to each room in which that the user might be located.

Accordingly, in some examples the sound characteristics of each of these areas may be learned over time, and therefore the audio sampling using a wearable device's microphone or other device microphone proximate to the user may be reduced over time once a sufficient level of confidence in the area's audio characteristics is reached. This may be done on a per-song basis if, for example, the user plays the same song over and over again and thus audio characteristics at different distances can be learned and stored over time. However, this may also be done on a per-frequency basis or global basis as well.

Audio adjustments may then be made based on tracking user location relative to the speakers themselves without also sampling the audio at the user's location (e.g., tracking using UWB location tracking using UWB transceivers on the wearable device and audio-controlling device/speakers) once a sufficient level of confidence has been reached in the sound characteristics of the area. Sound-dampening or blocking barriers such as walls and large furniture may also be deduced based on frequency drop-offs (e.g., of more than a threshold amount) at a specific location at which the wearable device microphone might be located or cross in a given instance. These techniques can preserve processor and power resources.

The GUI 500 may also include a setting 512 at which an end-user can establish the threshold volume level described above in reference to block 408 of FIG. 4 as a particular number of decibels. Thus, numerical input may be directed to input box 514 using a hard or soft keyboard to establish the threshold volume level.

Moving on from FIG. 5, it is to be understood consistent with present principles that certain components of a given piece of audio may fall within a treble frequency range while others may fall within a mid-range or bass frequency range. Treble frequencies may include frequencies in the range of 4,000 Hz and 20,000 Hz. Mid-range frequencies may include frequencies in the range of 250 Hz to 4,000 Hz. Bass frequencies may include frequencies in the range of 16 Hz to 250 Hz or even 60 Hz to 250 Hz in particular.

Also note consistent with present principles that in some examples, if a user is more than a threshold distance away from speakers producing audio and one or more components of the audio are above a threshold decibel level, one of the devices disclosed herein may control the speakers to lessen the volume level of the respective component(s) that are audible to a microphone at the user's location and hence audible to the user himself/herself. In some instances, this action may be performed only when another person is determined to be present within hearing range of the audio and/or in a space between the user and speakers.

Thus, in some examples, while the user is beyond the threshold distance each component of the audio may be lowered to zero volume or a default low-volume level or even a previously-used volume level before the user went beyond the threshold distance. Additionally or alternatively, the user may configure a max volume threshold via a GUI like the GUI 500 so that the overall volume and/or component-level volume as produced by the speakers does not exceed the max volume threshold. The user may establish these thresholds using a GUI like the GUI 500 of FIG. 5 to thus configure a distance beyond which volume levels of various components of the audio will not be cranked up but instead, for example, may be made inaudible by choice or capped to preserve the speaker hardware from blowing out.

It may now be appreciated that present principles provide for an improved computer-based user interface that increases the functionality and ease of use of the devices disclosed herein while optimizing system resources. The disclosed concepts are rooted in computer technology for computers to carry out their functions.

It is to be understood that whilst present principals have been described with reference to some example embodiments, these are not intended to be limiting, and that various alternative arrangements may be used to implement the subject matter claimed herein. Components included in one embodiment can be used in other embodiments in any appropriate combination. For example, any of the various components described herein and/or depicted in the Figures may be combined, interchanged, or excluded from other embodiments.

What is claimed is:

1. A first device, comprising:

at least one processor; and storage accessible to the at least one processor and comprising instructions executable by the at least one processor to:

identify at least one characteristic associated with audio as sensed at a first location, the audio produced at a second location that is different from the first location, the at least one identified characteristic comprising additional sound produced by an object based on the production of the audio, the object being different from one or more speakers used to produce the audio; and based on the at least one identified characteristic, adjust output of a first audio component in one or more of a first frequency of the audio and a first frequency band of the audio but do not adjust output of a second audio component in one or more of a second frequency of the audio and a second frequency band of the audio, the output of the first audio adjusted by lowering a volume level of the first audio component, the first audio component falling within a bass frequency range.

2. The first device of claim 1, wherein the identification is performed based on input from at least one microphone disposed at the first location.

3. The first device of claim 2, comprising the at least one microphone, wherein the identification is performed while the first device is at the first location.

4. The first device of claim 1, wherein the first second frequency/band falls within a treble frequency band.

5. The first device of claim 1, wherein the instructions are executable to:

adjust the output of the first audio component using a digital equalizer.

6. The first device of claim 1, wherein the bass frequency range comprises frequencies in the range of 16 Hz to 250 Hz.

7. The first device of claim 1, wherein the object is a first object, wherein the first object is a drinking glass, and wherein the at least one identified characteristic comprises additional sound produced by the drinking glass striking a second object based on the production of the audio.

8. The first device of claim 7, wherein the at least one identified characteristic comprises additional sound produced by the drinking glass repeatedly striking the second object in rhythm with the first audio component.

9. The first device of claim 1, wherein the at least one identified characteristic comprises additional sound produced by one part of the object vibrating relative to another part of the object in rhythm with the first audio component.

10. The first device of claim 1, wherein the instructions are executable to:

adjust the output of the first audio by progressively lowering the volume level of the first audio component until the additional sound is no longer detected.

11. The first device of claim 1, comprising the one or more speakers.

12. At least one computer readable storage medium (CRSM) that is not a transitory signal, the computer readable storage medium comprising instructions executable by at least one processor to:

identify at least one characteristic associated with audio as sensed at a first location, the audio produced at a second location that is different from the first location; and based on the at least one identified characteristic, adjust a first volume level of a first component of the audio in one or more of a first frequency and a first frequency range but not a second volume level of a second component of the audio in one or more of a second frequency and a second frequency range of the audio;

wherein the at least one identified characteristic associated with the audio comprises additional sound produced by an object based on the production of the audio, the object being different from one or more speakers producing the audio, and wherein the instructions are executable to:

based on the at least one identified characteristic, lower the first volume level of the first audio component, the first audio component falling within a bass frequency range, the bass frequency range comprising frequencies in the range of 16 Hz to 250 Hz.

13. The CRSM of claim 12, wherein the object is a first object, and wherein the at least one identified characteristic comprises additional sound produced by the first object repeatedly striking a second object in rhythm with the first audio component.

14. The CRSM of claim 12, wherein the instructions are executable to:

progressively lower the first volume level of the first audio component until the additional sound is no longer detected via a microphone.

15. A method, comprising:

identifying at least one characteristic associated with audio as sensed at a first location, the audio produced at a second location that is different from the first location, the at least one characteristic comprising additional sound produced by an object based on the production of the audio, the object being different from one or more speakers used to produce the audio; and based on the identifying of the at least one characteristic, lowering a volume level of a first audio component in a first frequency band but not lowering a volume level of a second audio component in a second frequency band, the second frequency band being different from the first frequency band, the first audio component falling within one or more of: a bass frequency band, a treble frequency band.

16. The method of claim 15, wherein the first audio component falls within the bass frequency band, the bass frequency band comprising frequencies in the range of 16 Hz to 250 Hz.

17. The method of claim 15, wherein the object is a first object, wherein the first object is a drinking glass, and wherein the at least one characteristic comprises additional sound produced by the drinking glass striking a second object based on the production of the audio.

18. The method of claim 15, wherein the object is a first object, and wherein the at least one characteristic comprises additional sound produced by the first object repeatedly striking a second object in rhythm with the first audio component.

19. The method of claim 15, wherein the at least one characteristic comprises additional sound produced by one object vibrating relative to another object in rhythm with the first audio component.

20. The method of claim 15, comprising:

progressively lowing the volume level of the first audio component until the additional sound is no longer detected.

* * * * *